US006722092B2

(12) United States Patent
Kunz et al.

(10) Patent No.: US 6,722,092 B2
(45) Date of Patent: Apr. 20, 2004

(54) PAPER BEAD

(75) Inventors: Roland Kunz, Omaha, NE (US); Roy R. Rantilla, Niles, OH (US)

(73) Assignee: Phillips Manufacturing Co., Omaha, NE (US)

( * ) Notice: Subject to any disclaimer, the term of this patent is extended or adjusted under 35 U.S.C. 154(b) by 0 days.

(21) Appl. No.: 10/324,916

(22) Filed: Dec. 20, 2002

(65) Prior Publication Data

US 2003/0089058 A1 May 15, 2003

Related U.S. Application Data

(63) Continuation-in-part of application No. 09/967,320, filed on Sep. 28, 2001, now abandoned, which is a continuation of application No. 09/573,022, filed on May 17, 2000, now Pat. No. 6,295,776.

(51) Int. Cl.[7] ..... E04B 1/00; E04F 13/06
(52) U.S. Cl. ..... 52/255; 52/256
(58) Field of Search ..... 52/255, 256; 156/153, 156/71

(56) References Cited

U.S. PATENT DOCUMENTS

| | | | | | |
|---|---|---|---|---|---|
| 2,234,701 | A | * | 3/1941 | Lyman | 52/417 |
| 3,090,087 | A | * | 5/1963 | Miller | 52/287.1 |
| 3,109,207 | A | * | 11/1963 | Cooper | 52/255 |
| 5,131,198 | A | * | 7/1992 | Ritchie et al. | 52/287.1 |
| 5,613,335 | A | * | 3/1997 | Rennich et al. | 52/255 |
| 5,836,122 | A | * | 11/1998 | Rennich et al. | 52/254 |
| 6,148,573 | A | * | 11/2000 | Smythe, Jr. | 52/255 |
| 6,295,776 | B1 | * | 10/2001 | Kunz et al. | 52/255 |
| D457,658 | S | * | 5/2002 | Harel | D25/121 |
| 2003/0033770 | A1 | * | 2/2003 | Harel | 52/287.1 |
| 2003/0110721 | A1 | * | 6/2003 | Harel | 52/287.1 |

* cited by examiner

*Primary Examiner*—Robert Canfield

(57) ABSTRACT

A tape-on drywall accessory includes an elongated metal core strip with a longitudinal arcuate nose and a pair of flanges extending outwardly from the nose. A cover strip of paper is bonded to the exterior surface of the core strip, and includes wings that project outwardly beyond the extent of the flanges. The cover strip is formed of a non-latex-bearing stock paper having high pick resistance and which is dimensionally stable and has high peel bond strength when in contact with wet joint compound.

9 Claims, 2 Drawing Sheets

PAPER BEAD

CROSS-REFERENCES TO RELATED APPLICATIONS

This is a Continuation-In-Part of Ser. No. 09/967,320, filed Sep. 28, 2001 ABN, which is a continuation of Ser. No. 09/573,022, filed May 17, 2000 U.S. Pat. No. 6,295,776.

STATEMENT AS TO RIGHTS TO INVENTIONS MADE UNDER FEDERALLY SPONSORED RESEARCH AND DEVELOPMENT (Not applicable)

BACKGROUND OF THE INVENTION (1) Field of the Invention

The present invention relates generally to drywall construction, and more particularly to an improved corner bead strip with paper wings.

(2) Background Information

Current building construction utilizes sheets of drywall, commonly referred to as "wallboard," to form the surfaces of interior walls of buildings. Drywall, or wallboard, is typically formed of sheets of plaster sheathed in an outer wrapping of heavy construction paper.

In wallboard construction, joints between adjacent sheets of drywall are usually covered by a paper tape extending lengthwise along the joint. The conventional drywall tape is provided in narrow elongated strips of porous paper wound into rolls. The drywall tape is applied to the joints, and then covered with wet plaster or "mud". The plaster is feathered and smoothed along the edges of the tape to conceal the tape edges and form a smooth unmarred surface where the wallboard adjoins.

It is often necessary to cut the wallboard to form a corner, which thereby exposes the plaster contained between the heavy paper sheets. This exposed plaster tends to crumble unless these edges are protected. To finish exterior corners in wallboard construction, metal corner beads and bullnose beads are typically installed. Such corner beads are conventionally formed by roll-forming from an elongated strip of sheet metal, and provide a round nose with two mounting flanges extending at substantially right angles from the opposing sides of the nose. These mounting flanges are often knurled or embossed to provide a rough surface so that the joint compound will adhere when the corner is finished. Similarly, metal trim is used to protect and finish a wallboard edge at window and door jams, while expansion joints are inserted between sheets of wallboard at predetermined intervals within buildings.

The corner bead is installed by securing the mounting flanges along the surface of the drywall panels adjacent to the corner by nails or the like. Wet plaster is then smoothed into place to cover the metal flanges, and edges of the plaster are smoothed and feathered to cover and conceal the metal edges.

Another type of corner bead is referred to as a "tape-on" bead. Tape-on corner beads utilize a strip of paper covering the exterior surface of the metal corner angle, with wings projecting outwardly from the legs of the corner angle. Wet plaster or joint cement secures these paper wings to the drywall, to secure the corner bead in position, rather than using nails or other fasteners. Wet plaster or joint cement for finishing the corner will normally adhere significantly better to the paper cover strip of tape-on beads, than to the exposed metal of conventional nail-on beads. Nail-on beads are also typically more susceptible to developing crack lines along the outer edges of the flanges, than are tape-on beads. In addition, tape-on beads are more tolerant of dimensional and geometric changes in the underlying construction framing than are nail-on beads with their rigid mechanical attachment to the construction framing.

One of the main problems with prior art tape-on bead is the use of standard joint/drywall tape on the bead. Such drywall tape is very fibrous, which is good for bond strength, but poor for appearance. During the application of joint cement over the tape, to adhere the corner bead to the drywall, fibers will project and protrude with only minimal contact by the application tools. These fibers will ball up during the course of sanding of the joint cement for the final finish, thereby detracting from the finished appearance of the corner.

One method for improving protection against adverse abrasion of this paper strip is disclosed in U.S. Pat. Nos. 5,613,335 and 5,836,122, both to Rennich et al. These patents disclose a paper bead (tape-on bead) utilizing a paper layer which is uniformly impregnated throughout its thickness with latex or similar strengthening compound with a high wet strength so as to make the paper strip resistant to scuffing and abrasion throughout its thickness. This impregnated stock paper would have a high pick resistance or surface fiber bond, and would effectively inhibit separation of surface fibers during application on wallboard, thereby providing a good finished appearance in installation. However, the applicants herein have found that paper of this type, which is impregnated with latex or the like, exhibits poor joint compound bonding properties, as applied under the ASTM bond strength tests.

More specifically, ASTM C-475-01 recites a variety of standards for joint tape, including the following three standards:

4.3.3 Tensile Strength—Shall be not less than 30 lbf/in. (524 N/mm) in the cross direction.

4.3.4 Dimensional Stability—Shall expand not more than 0.4% lengthwise and not more than 2.5% crosswise.

4.4.1 Bond—between the joint tape and joint compound shall be not less than 90%.

These terms are used throughout this application, and are intended to refer to the standards set forth in ASTM C-475-01. The test method for determining bond strength or the "peel bond" percentage recited in ASTM C-475-01, is set forth in ASTM C-474-01. Section 3.2.1 defines "bond" as the "quality of adhesion between the paper joint tape and joint compound. Thus, the inventors herein have also described this as the "peel bond", or the amount of force required to peel the joint tape from the joint compound.

Section 13 of ASTM C-474-01 describes the methodology for calculating the percent bond set forth in ASTM C-475-01. The pertinent portions of that section are set forth herein in more detail, for a better understanding of the bond percent. First, the apparatus used in the sampling are described, and include "feeler gage strips", and an "overlay transparency grid". The feeler gage strips are described in 13.4.1 as being "12 in. (300 mm) long, ½ in. (13 mm) wide, and 0.025 in. (0.64 mm) thick with a small hole drilled in one end. The overlay transparency grid is defined in 13.4.4 as "a transparent photocopy of 10 by 10 divisions/in. graph paper. An area 2 by 5 in. (51 by 127 mm) enclosing 1000 square divisions is outlined.

The Procedure for determining percent bond is described in Section 13.5 as follows:

13.5.1 Place two feeler gage strips parallel to each other about 4 inches (102 mm) apart and fasten to the face of the gypsum wallboard with a thumb tack through the hole in the end.

13.5.2 Using the steel reinforced broad knife, apply an amount of joint compound sufficient to cover the area between the feeler gage strips. Spread the specimen evenly between the feeler age strips leaving the specimen slightly thicker than the strips.

13.5.3 Center a 12-in. (305 mm) length of paper tape in the specimen. Press one end of the tape into the specimen and hold it in place.

13.5.4 Embed the tape by applying two or three pressure strokes with the steel-reinforced broad knife. Wipe away from the end being held so the excess joint compound is squeezed out.

NOTE 8—The thickness of the joint compound plus the tape is about 0.025 in. (0.64 mm).

13.5.4.1 Carefully remove the feeler gages before drying.

13.5.5 Allow the test assembly to dry to constant weight in an atmosphere of 75+/−5° F. (24+/−2° C.) and 50+/−5% relative humidity.

13.5.6 When the test assembly is dry, use a sharp knife to make a cut across and perpendicular to the tape 3½ in. (90 mm) from one end. Make a second cut 5 in. (130 mm) from and parallel to the first cut. Make two diagonal cuts across the tape connecting the opposite corners of the 5-in. (130 mm) section. With the tip of the knife, peel back the tabs formed by the "X" cuts and pull up sharply.

13.5.6.1 Make a second test by repeating 13.5.6 below the first test.

13.5.7 Using a sharp pencil, lightly outline the area where fiber remains attached to the compound. Align the overlay transparency grid so that the grid outline matches the 2 by 5-in. (51 by 127-mm) sides of the tape bond area.

Section 13.6 of ASTM C-474-01 then sets forth the procedure for calculating the percent bond, as follows:

13.6.1 Using the overlay transparency grid, count the number of squares that are more than half bare of fiber separated from the tape and outlined by pencil.

13.6.2 Subtract this number from 1000 and divide by 10 to determine the percent bond. Record the average of the two tests.

As described above, "pick resistance" relates to the surface bond of the joint tape, and the resistance to balling of fibers upon finishing or dressing a corner by sanding. The paper exhibits high pick resistance if there is little or no balling or protruding of fibers upon dressing the corner. On the other hand, the paper exhibits low pick resistance if there are protruding fibers or balling upon the dressing of the corner.

BRIEF SUMMARY OF THE INVENTION

It is therefore a general object of the present invention to provide an improved tape-on corner bead with paper wings, which exhibits high bond strength.

Yet another object is to provide an improved tape-on corner bead which will firmly bond to the drywall construction, the supporting metal corner angle, as well as the joint cement applied over the top thereof.

A further object of the present invention is to provide a method for constructing tape-on corner bead which permits secure attachment of the corner bead to wallboard.

These and other objects will be apparent to those skilled in the art.

The corner bead of the present invention is of the tape-on type, having an elongated metal core strip with a longitudinal arcuate nose and a pair of flanges extending outwardly from the nose. A cover strip of paper is bonded to the exterior surface of the core strip, and includes wings that project outwardly beyond the extent of the flanges. The cover strip is formed of a non-latex-bearing stock paper having high pick resistance and which is dimensionally stable and has high peel bond strength when in contact with wet joint compound.

BRIEF DESCRIPTION OF THE SEVERAL VIEWS OF THE DRAWING

The preferred embodiment of the invention is illustrated in the accompanying drawings, in which similar or corresponding parts are identified with the same reference numeral throughout the several views, and in which.

DETAILED DESCRIPTION OF THE INVENTION

Figure 1:
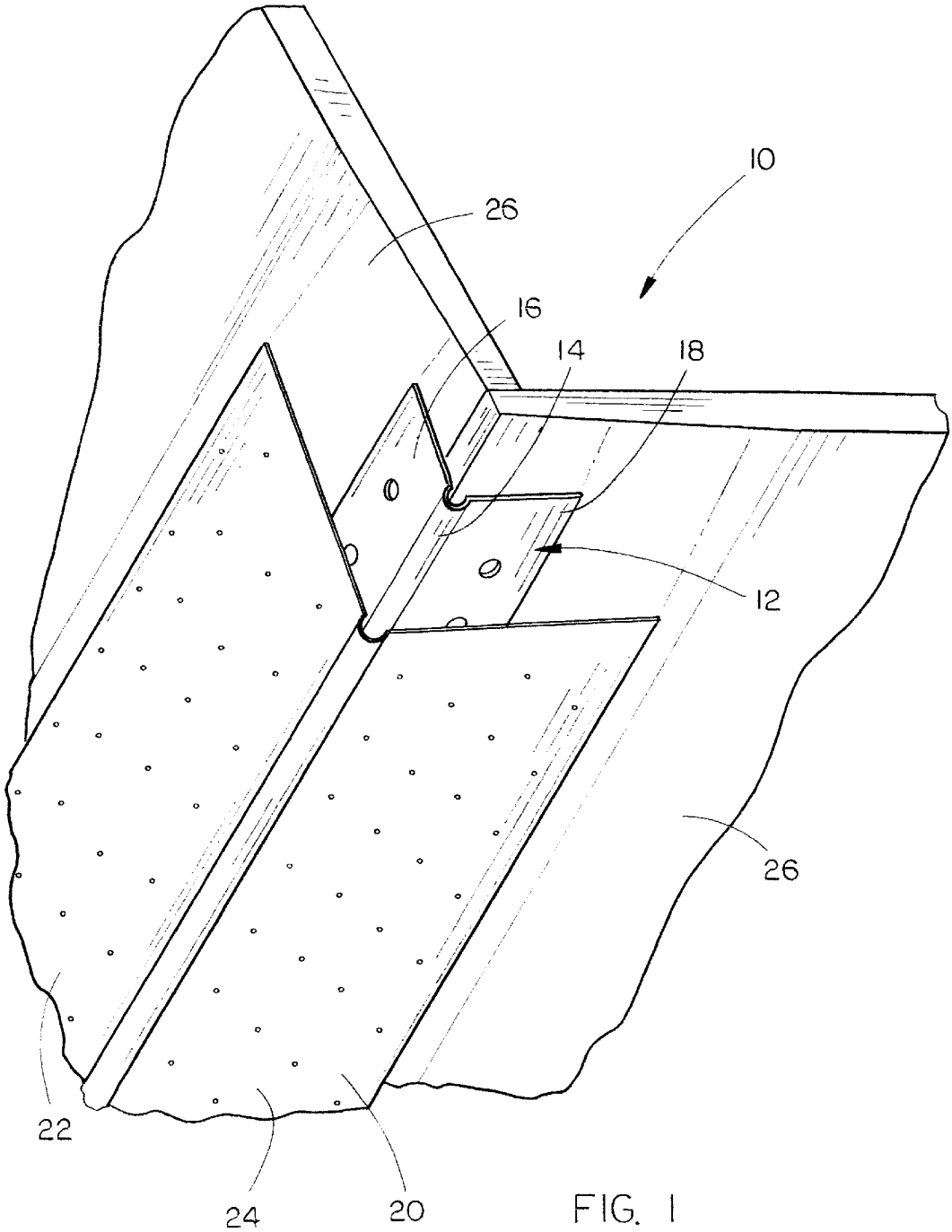
FIG. 1 is a perspective view of the corner bead of the present invention exploded away from an exterior corner of wallboard construction.
Figure 3:
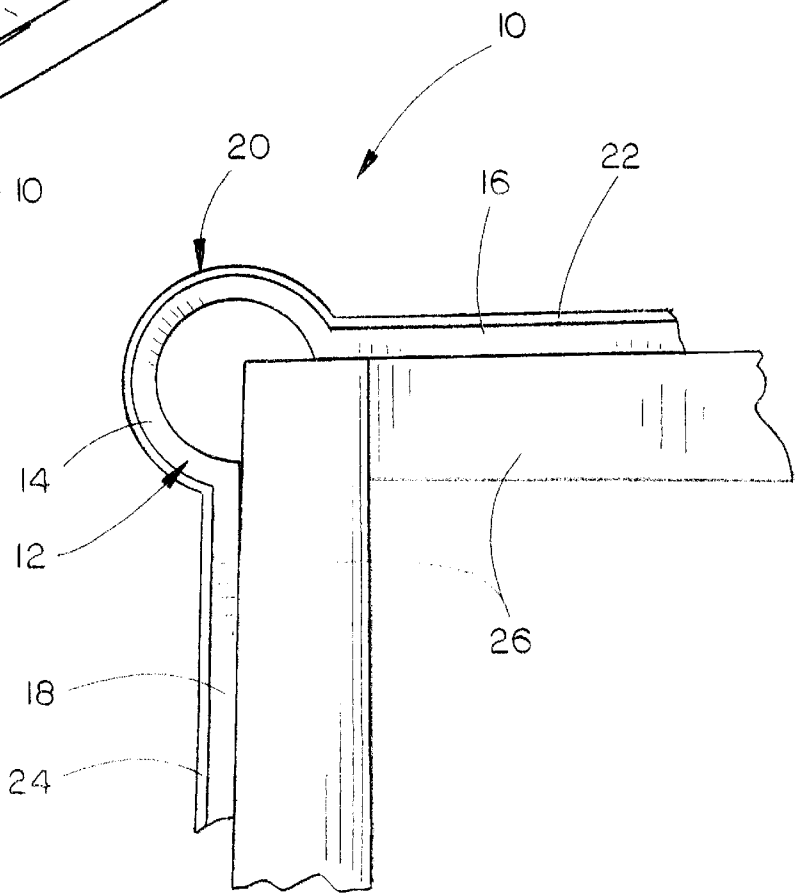
FIG. 3 is an enlarged top view of the corner bead mounted on a corner of wallboard construction.
Figure 2:
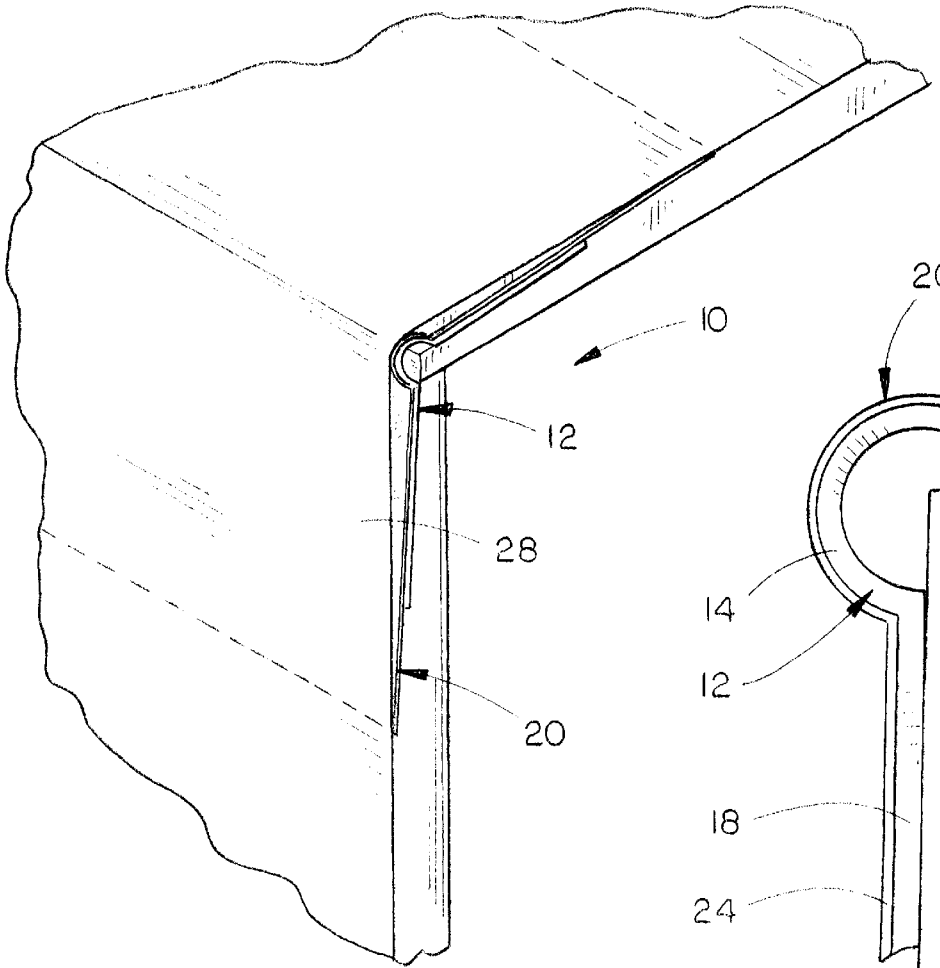
FIG. 2 is a perspective view of a corner of wallboard construction with the corner bead of the present invention thereon, and covered with joint cement for a finished surface.

Referring now to the drawings, in which similar or corresponding parts are identified with the same reference numeral, the corner bead of the present invention is designated generally at 10 and includes an elongated metal core strip 12 with a central arcuate longitudinal channel forming a nose 14, and with flanges 16 and 18 extending outwardly from each edge of the channel of nose 14 at slightly less than a right angle.

Core strip 12 is preferably a galvanized steel strip having a thickness of approximately 0.014 inches, which has been roll-formed. In the preferred embodiment, the flanges 16 and 18 are ¾ inch in length, measured from the edges of nose 14. The typical core strip nose will have an outside radius of up to about 1.5 inches, and project outwardly from the plane of the flanges approximately 0.033 inches, to provide space to receive joint compound, to cover and "dress" the corner.

In the method of assembly of the corner bead, a continuous steel strip first passes through a performing roll forming section. The preforming section, by means of progressive contoured rolls, forms the steel core strip 12 into a cross-section that begins to conform to the desired finished shape of the corner bead. This preformed steel strip then progresses into an assembly section.

A continuous length of paper strip enters a paper conditioning section, wherein mechanical abrasion breaks some of the surface bond of the paper fibers and simultaneously, by means of a roller die, pierces a plurality of small apertures through designated regions of the paper. In an alternative embodiment, the surface of the paper is not abraded, but a plurality of apertures are pierced through designated regions of the paper. The perforated paper strip then progresses to the assembly section for attachment to the preformed core.

In the assembly section, the conditioned paper strip is guided through a preheating section that brings the paper to a suitable elevated temperature to improve the subsequent adhesive bonding. It then passes against a slot type hot melt adhesive applicator head, which applies a stripe of adhesive to the paper. The design of the slot head, along with control over the relative travel speed of the paper strip and the rate of flow of adhesive, regulate the location, width and thickness of the adhesive stripe. The heated paper strip with adhesive thereon is then guided into contact with the steel core preform. The assembly of steel core preform, adhesive and paper strip then progresses into a finish forming section.

In the finish forming section, the assembly passes through a second series of contoured forming rolls. These rolls form the assembly into the desired finished crosssectional shape of the corner bead, and simultaneously provide the necessary pressure to achieve the bond between the paper strip 20 and steel core strip 12. The bonded and formed corner bead then progresses to a cut off section where the corner bead 10 is sheared into the desired finished length.

The selection of the paper of paper strip 20 is critical to the invention. Conventional joint tape paper has low pick resistance, which results in good bond strength with joint compound, but produces a product that is difficult to finish. The scraping and sanding that occur in drywall finishing will separate the surface fibers of the paper, resulting in balling and/or protruding fibers and a resulting poor finished appearance.

A stock paper impregnated with latex, or other strengthening compound, to a relatively uniform concentration through its thickness would have a high pick resistance or surface fiber bond. Thus, the impregnated paper would effectively inhibit the separation of surface fibers during drywall application, and would provide a good finished appearance in installation. This type of paper is described in U.S. Pat. Nos. 5,613,335 and 5,836,122, described above. However, the inventors' own tests on such paper have found that the paper did not have the desired performance in resisting peeling, or "peel bond" strength, as set forth in ASTM standards.

Another particular type of paper that was tested is wallpaper stock (or hanging stock). This type of paper is impregnated from one side with a polymer intended to make the paper printable and scuff resistant, while the opposite side of the paper remains highly bondable. While these are highly desirable properties, the wallpaper stock is not suitable because of a lack of dimensional stability. The paper expands considerably on exposure to moisture, which causes a buckled appearance when imbedded in joint compound.

The preferred paper stock therefore must have a high pick resistance, high tensile strength, and be dimensionally stable and have a high peel bond strength on contact with wet joint compound. The inventors herein have found that a paper produced by E. B. Eddy's (Domtar) brand code 5520/150 GSM Sand Back meets all of these requirements. This paper is produced without the impregnation or coating of latex or other strengthening compounds, and was designed for use as a sandpaper backing stock. Tests have been conducted both with plain white paper, as well as colored samples, utilizing the method of assembly as described above, and using ASTM standards for determining acceptable limits for each of the desired properties, and have shown that this paper meets all of the inventors' requirements. Thus, the use; of a non-impregnated, non-coated paper on a corner bead can produce a corner bead with a higher peel bond strength when installed on wallboard than impregnated or coated paper.

As shown in the drawings, the preferred embodiment of the invention utilizes a paper cover strip 20 with wings 22 and 24 affixed to flanges 16 and 18 respectively, and extending beyond flanges 16 and 18. The paper preferably has a thickness of about 0.007 inches and will project beyond flange 16 and 18 approximately ⅝ of an inch. A plurality of very small diameter holes, preferably 0.005 to 0.02 inches in diameter, are punched through the cover strip to assist in adhering the paper strip to the wallboard 26, the core strip 12, and joint cement 28 applied to the exterior surface thereof. However, these holes are not an absolute requirement for the invention.

The inventors have found that paper with an off-white tint is preferable, so as to match the color of the drywall facing paper and joint cement. In this way, if a portion of the joint cement is sanded away to reveal the paper strip, the color of the paper strip will closely match the color of the wallboard and will not reveal any stark contrasts.

Corner bead 10 is applied in a conventional manner for tape-on beads. Once the joint cement covering the cover strip 20 from nose 14 outwardly over wings 22 and 24 has dried, the joint cement is sanded.

Whereas the invention has been shown and described in connection with the preferred embodiments thereof, many modifications, substitutions and additions may be made which are within the intended broad scope of the appended claims. More specifically, this invention may be applied to all varieties of drywall accessory or trim, including those types described in ASTM C-1047-99. More specifically, the ASTM standard at the time of this application defines "accessories" as including corner beads, edge trims, and control joints, such as casing beads, bull noses, and stops.

What is claimed is:

1. A tape-on drywall accessory for drywall construction, comprising:

an elongated core strip having a longitudinal arcuate channel forming a nose, and a pair of flanges extending outwardly from each side of the nose;

a cover strip affixed to an outward face of the core strip, with wings extending beyond the extent of the flanges; and said cover strip formed of a paper with a pick resistance of sufficient magnitude to prevent balling of surface fibers during finishing, which is dimensionally stable when in contact with wet joint cement, and which and has a peel bond strength of at least about 90%.

2. The tape-on drywall accessory of claim 1, wherein said cover strip is further formed of a paper with a tensile strength of not less than 30 lbf/in. (524 N/mm) in the cross direction.

3. The tape-on drywall accessory of claim 1, wherein said cover strip is a non-latex-bearing paper.

4. The tape-on drywall accessory of claim 1, wherein said cover strip is neither impregnated, nor coated with a strengthening compound.

5. The tape-on drywall accessory of claim 1, wherein the wings are perforated with a plurality of apertures having diameters of approximately 0.005 to 0.02 inches.

6. The tape-on drywall accessory of claim 1, wherein said core strip is metal.

7. The tape-on drywall accessory of claim 6, wherein said metal is galvanized steel.

8. The tape-on drywall accessory of claim 1, wherein said drywall accessory is corner bead.

9. The tape-on drywall accessory of claim 1, wherein said cover strip has lengthwise and crosswise directions, and wherein the cover strip is formed of a paper that does not expand more than 0.4% lengthwise or more than 2.5% crosswise, when in contact with wet joint compound.

* * * * *